US005139160A

United States Patent [19]

Romano

[11] Patent Number: 5,139,160

[45] Date of Patent: Aug. 18, 1992

[54] PORTABLE KNOCKDOWN WALLPAPER HOLDING AND CUTTING RACK

[76] Inventor: John Romano, 66-15 69th St., Middle Village, N.Y. 11379

[21] Appl. No.: 667,281

[22] Filed: Mar. 11, 1991

[51] Int. Cl.[5] ..... A47F 7/00

[52] U.S. Cl. ..... 211/13; 211/44; 242/55.3

[58] Field of Search ..... 211/44, 13, 189; 242/55.3

[56] References Cited

U.S. PATENT DOCUMENTS

| | | | |
|---|---|---|---|
| D. 76,906 | 11/1928 | Victor | 211/44 X |
| 559,795 | 5/1896 | Frank | 242/55.3 X |
| 640,187 | 1/1900 | Eley | 211/44 X |
| 781,759 | 2/1905 | Barton | 242/55.3 |
| 906,347 | 12/1908 | Willner | 211/44 X |
| 2,109,379 | 2/1938 | Brown | 211/44 X |
| 2,372,500 | 3/1945 | Knowles et al. | 242/55.3 X |
| 4,783,017 | 11/1988 | Ovitz, III et al. | 242/55.3 |

*Primary Examiner*—Robert W. Gibson, Jr.
*Attorney, Agent, or Firm*—Nicholas J. Garofalo

[57] ABSTRACT

The invention is a rack having a pair of opposed upright columns between which rolls of wallpaper may be held upon dowel rods for unrolling. Below the dowel rods a unit is mounted between the columns. The unit includes a cutter guide member which is raisable relative to an underlying support, whereby paper may be drawn from a roll beneath the cutter guide member and over the support. The cutter guide member serves as a guide along which a knife may be drawn to cut from the roll a section of paper resting upon the support with a straightedge. And the principal components of the rack are held together by four bolts, whereby the rack may be readily knocked-down to its components upon removal of the bolts. The knocked-down components are light in weight, and may be piled together into a compact flat pack for manual portage and subsequent reassembly.

8 Claims, 1 Drawing Sheet

PORTABLE KNOCKDOWN WALLPAPER HOLDING AND CUTTING RACK

BACKGROUND OF THE INVENTION

This invention is directed to a portable knockdown rack that is designed to hold a roll of wallpaper and has a guide unit through which the paper may be drawn and supported for cutting lengths of paper from the roll.

In preparing wallpaper for hanging, lengths of the paper are initially cut from the roll. In doing this, it is customary to rest the roll of paper upon a table and to then manually draw a free end of the paper over the table surface to a measured extent. A yard stick is then laid across the paper, and a knife is drawn along the stick to cut a section of paper from the roll. This action is repeated until the papering work is completed. In this process, difficulty in experienced in holding the roll in place while a length of the paper is being drawn from it. Often, the roll is caused to move irregularly about and tear on to drop off the table. The need to manually lay a yard stick across the paper each time a length of the paper is to be cut also has its problems in that it is not always properly positioned and irregular cuts of paper result. It it also a common practice in unrolling lengths of the paper across the table prior to cutting to do so with the back face up. This has its faults in that defects which may exist in the pattern face of the paper cannot be noticed until the paper is subsequently turned pattern face up. It is customary in preparing sections of paper for hanging to cut the sections for side to side matching of the patterns and to do so with a minimum waste of paper. To this end, two rolls of paper having the same pattern are used, and sections of the paper are cut in sequence alternately from the two rolls. The present method of doing this has its faults in that the rolls of paper are alternately picked up from the table or floor according to where they are resting and laid down again. Such action involves an undesirable waste of energy and loss of time, and often results in mismatching.

The present invention enables the unrolling, matching and cutting of walllpaper without the faults mentioned. With the present invention the roll of paper is supported in such manner that it may be unrolled and drawn over the work table pattern face up at all times, whereby any defects that may exist in the pattern are readily noticeable. The rack of the present invention is adapted to support two rolls of paper, whereby the rolls may be alternately unrolled in sequence for cutting lengths of the paper for side by side matching of the patterns. Also, a component of the rack is a cutter guide or stick which enables a straightedge cutting of the paper at all times, and which is not required to be manipulated to a proper position for each cutting operation. Further, the rack of the present invention has a knockdown structure. Its components are few and structured so that they may be readily assembled and secured together by as little as four bolts. And, when a job employing the rack has been completed, the several components of the rack may be readily unbolted from one another. Further, they may then be laid upon one another and preferably bolted together to provide a flat compact manually portable pack. Its knockdown feature provides various benefits. particularly in portage, storage and ready replacement of parts.

The invention further lies not only in the particular structure and arrangement of its parts, but also in their mode of association with one another to effect the objects and advantages intended herein.

BRIEF SUMMARY OF THE INVENTION

The invention provides a knockdown rack having means for supporting multiple rolls of wallpaper, and having a cutter guide unit through successive lengths of the paper may be drawn from a roll and subjected to a knife drawn by a worker along guide over the paper to sever a length of paper from the roll. As a knockdown rack , its components may be readily assembled to one another for use of the rack; or they may be readily disassembled from one another and packed into a manually portable compact pack for subsequent reassembly.

The foregoing structure of the invention, its features and advantages will become increasingly apparent as this specification unfolds in greater detail and as it is read in conjunction with the accompanying drawing wherein an embodiment of the invention is illustrated. It is to be expressly understood, however, that the drawing is for purposes of illustration and description, and it is not to be construed as defining the limits of the invention.

DETAILED DESCRIPTION OF THE INVENTION

Figure 3:
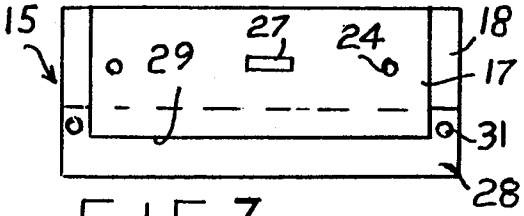
FIG. 3 is a detail in plan of the cutter guide unit.

The knockdown rack embodying the invention, as illustrated in the accompanying drawing, is a unitary structure. It has a rectangular base 1 that serves to support the rack upon a floor surface. Mounted upon opposite marginal end areas of the base is a pair of parallel narrow flat surfaced columns 2. Each column extends vertically up from the base with a slide fit through a complementary slot 3 in the base. A flat surfaced rib or foot 4 is fixed to the bottom end of the column. The foot is seated in a complementary recess 5 at the underside of the base. The column is held in its vertical position by means of an angle bracket 6. One arm 7 of the bracket is fixed in suitable manner to the surface of the base. A second arm 8 of the brackets abuts the outer face of the column, and it is tightened against the column by a bolt 9. The bolt extends through aligned holes in the arm 8 and the column, and it is tightened in a T-nut 11, also known as a collar nut, embedded in the column. The foot end of the column in its seated condition in the recess, together with the bolted bracket, maintains the column in its vertical position, restrained against wobble or turning about the bolt.

At an upper level of the rack a horizontally extending dowel rod 12 is supported at its ends by the columns. The rod extends slidably through a hole 13 in each column and projects at its ends from the outer faces of the columns.

The rod serves to support a roll of wallpapers 14 in a level horizontal condition between the columns. To mount the rolls onto the rod, the rod is manually slipped clear of one of the columns sufficiently to allow the roll to be positioned between the columns. The rod is then slipped through an axial opening in the roll and returned thorugh the hole in the column.

A second dowel rod 120 is similarly supported by the columns. It is spaced above the lower rod sufficiently to hold a second roll of wallpaper 140 clear of the roll mounted upon the lower rod.

The free end of a roll of wallpaper supported on either rod is adapted to be drawn from the roll and passed through a cutter guide unit 15 onto a work table, not shown. The unit serves to support paper drawn from the roll; and it also acts as a guide to movement of a knife by a worker for cutting with a straightedge a length of paper from the roll. The cutter guide unit comprises a cutter guide panel 17 resting upon an underlying paper supporting panel 18.

The cutter guide unit 15 is supported on a level horizontal plane between the two columns and below the dowel rods. The paper supporting panel 18 is slidably received at each end in a complementary dado 19 notched across the inner face of the corresponding column. Fixed to the underside of the supporting panel is a pair of braces 21, each of which depends from a marginal end area of the panel and abuts against the inner face of the corresponding column. Each brace is tightened against the column by a bolt 22. The bolt extends through aligned holes in the column and the brace, and is tightened in a T-nut 23 embedded in the brace. The braced condition of the panel restrains it from sliding endwise free of the columns.

The cutter guide panel 17 is slidable vertically relative to the underlying paper supporting panel 18 so as to allow paper drawn from the roll to be passed beneath the guide panel and over the supporting panel. The supporting panel serves as a support for the paper as it is being cut from the roll; and the guide panel serves as a guide to movement of a knife in cutting the paper.

An elongated bolt 24 is mounted on each end area of the supporting panel. Each bolt is retained at its bottom end to the panel by a T-nut 25 embedded in the panel. The bolt projects vertically above the panel and extends with a slide fit through a complementary hole 26 in the guide panel, whereby the guide panel is vertically slidable relative to the bolt and the supporting panel. A tab 27 on the guide panel may be manually gripped to raise the guide panel.

The supporting panel is wider than the overlying guide panel, whereby a narrow marginal portion of the supporting panel fronts the guide panel. A metal plate 28 is seated in a recess that extends over this marginal portion and partly beneath the guide panel. The guide panel has a longitudinally extending front edge 29 which overlies the metal plate. The front edge serves as a guide for a worker's knife as he moves it along the edge to obtain a straightedge cutting of a section of the paper passed beneath it and supported upon the supporting panel. Plate 28 is preferably of zinc metal, as this metal serves favorably in limiting dulling of a knife blade as the blade is moved along the guide panel in cutting a section of paper from the roll. The metal plate also serves to avoid destruction of the supporting panel, which would otherwise occur if the metal plate were not present. The metal plate is removably fastened in suitable manner, as by screws 31, to the supporting panel, whereby it may be readily removed when worn and replaced by a new one.

In making use of the rack, a roll of wallpaper is put upon one of the dowel rods with the pattern face of the paper fronting the rack and the worker. Then, while the cutting guide panel 17 is manually raised, a free end of the roll of wallpaper is drawn about a rounded back surface 32 of the guide panel, passed beneath the guide panel and forwardly over the supporting panel 18 onto a work table, not shown. After a measured length of the paper is drawn over the supporting panel, the guide panel is allowed to slide down upon the paper and a knife is drawn by the worker along the front edge 29 of the guide panel to cut the paper from the roll. Section after section of paper is drawn through the cutter unit 15 and cut until the roll of wallpaper is exhausted. Each section obtains a straightedge cut as it is cut by the knife from the roll. A second roll of wallpaper 140 may, if needed for the work, be placed upon the upper dowel rod.

As described, the rack embodying the invention is of a knockdown nature. Its various components are formed for easy and quick assembly to form the rack, or to enable the rack to be disassembled back to its components for manual portage and subsequent reassembly. It is a simple procedure to knockdown the rack. The dowel rods are first slipped free of the columns 2. It is then only required that the four bolts 9, 22 be removed. Removing the two bolts 22 allows the cutter guide unit 15 to be slipped free of the two columns. Removing the two bolts 9 frees the two columns from the brackets. The two columns may then be slipped out of the slots 3 and separated from the base 1.

Figure 4:
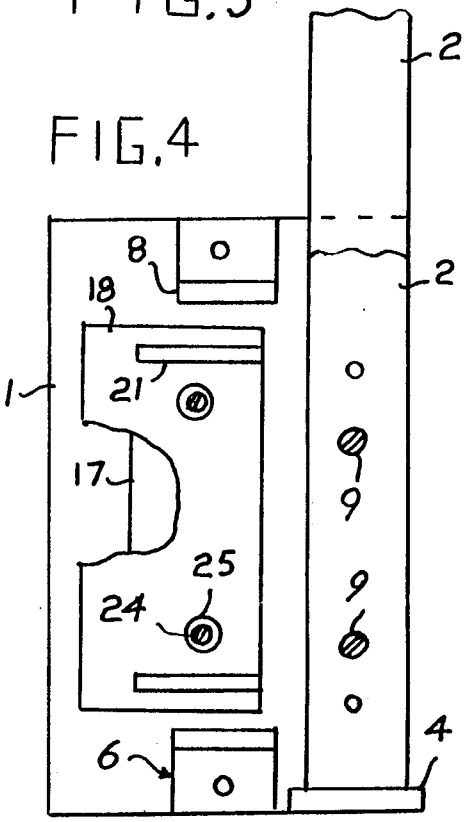
FIG. 4 is an elevational view showing the components of the rack knocked-down and arranged in a compact pack for manual portage.
Figure 1:
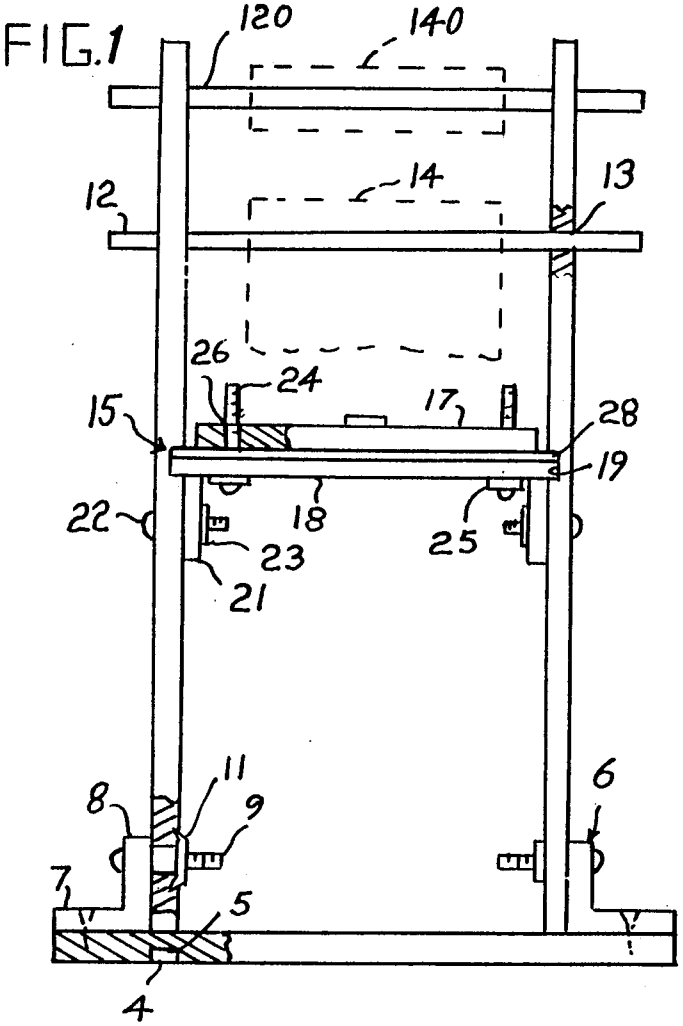
FIG. 1 is a front elevational view of a manually portable knockdown rack embodying the invention for holding multiple rolls of wallpaper and cutting lengths of paper from the rolls.
Figure 2:
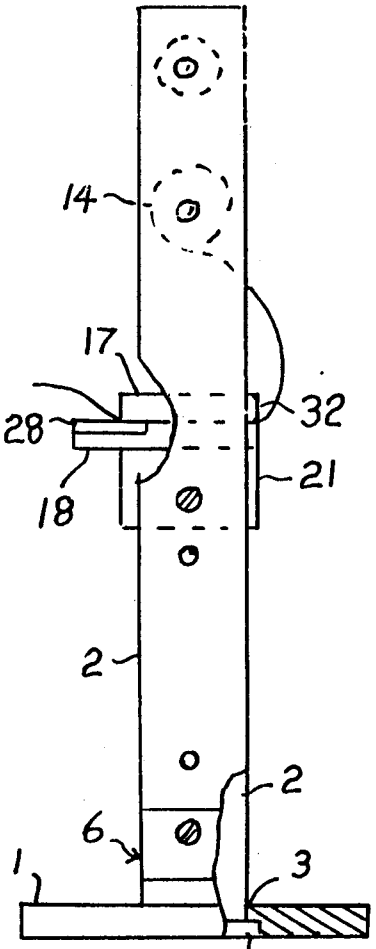
FIG. 2 is a side elevational view of the rack.

The several components of the rack, comprising the base, the two columns, the cutter guide panel and the paper supporting panel are light in weight and preferably of wood material. When disassembled, the components may be packed upon one another to form a compact flat pack, as indicated in FIG. 4. In this respect, the two columns 2 are placed, one atop the other, upon a marginal area of the base 1 and are bolted to the base by bolts 9 passed through holes in the columns and tightened in T-nuts, not shown, embedded in the base; and the cutter guide unit 15 is placed upon an adjacent marginal area of the base with the elongated bolts 24 of the supporting panel passing through the holes of the guide panel and tightened in T-nuts, not shown, embedded in the base. The result is a compact flat pack which may be manually carried by using an arm 8 of the supporting panel as a handle; or the pack may be manually carried under the arm of the worker.

What is claimed is:

1. A knockdown rack for holding a roll of wallpaper and providing a support over which paper from the roll may be drawn and supported to allow cutting of the drawn paper from the roll, the rack comprising: a floor restable base member, a parallel pair of laterally spaced vertically extending columns removably mounted upon the base member, a dowel rod supported at its ends by the columns and slidably removable from the columns, the dowel rod extending horizontally across the space between the columns and adapted to have a roll of wallpaper axially received upon it, a horizontally extending paper supporting panel spaced below the dowel rod and removably mounted at its end to the columns, a cutter guide panel resting upon the paper supporting panel, bolt means projecting up from opposite end areas of the paper supporting panel and through complementary holes of the cutter guide panel whereby the cutter guide panel is vertically slidable relative to the paper supporting panel, the cutter guide panel being adapted to be manually raised to allow paper drawn from the roll to be passed beneath it and over the paper supporting panel, the cutter guide panel being narrower in width than the paper supporting panel whereby a longitudinally extending marginal portion of the paper supporting panel fronts the cutter guide panel, and the cutter guide panel having a longitudinally extending front edge adapted to serve as a guide along which a knife may be drawn to cut the drawn paper from the roll.

2. A knockdown rack as in claim 1, wherein a metal plate is recessed into the marginal portion of the paper supporting panel and underlies along a rear portion thereof the front edge of the cutter guide panel.

3. A knockdown rack as in claim 2, wherein the metal plate is of zinc material.

4. A knockdown rack as in claim 3, wherein a second dowel rod adapted to hold a second roll of wallpaper is spaced above the first mentioned dowel rod and is similarly supported at its end by the columns.

5. A knockdown rack for holding a roll of wallpaper and having a support over which the paper may be drawn and supported to allow cutting of the paper from the roll, the rack comprising: a pair of laterally spaced vertical columns, a plurality of horizontally extending dowel rods spaced one above the other and slidably supported at their ends by the columns, a base adapted to rest upon a floor surface upon which base the columns are removably mounted, and a cutter guide unit disposed horizonally between the columns below the dowel rods, the unit comprising a paper supporting panel removably mounted at its ends to and between the columns, and a cutter guide panel resting upon the paper supporting panel, means slidably supporting the cutter guide panel upon the paper supporting panel allowing manual lifting of the cutter guide panel sufficiently to allow paper drawn from the roll to be passed beneath the cutter guide panel and over the paper supporting panel, and the cutter guide panel upon being rested upon the drawn paper providing a longitudinally extending edge adapted to serve as a guide along which a knife may be drawn to cut the drawn paper with a straight edge from the roll.

6. A knockdown rack for holding a roll of wallpaper and providing a support over which paper from the roll may be drawn and supported to allow cutting of the drawn paper from the roll, the rack comprising: a base member, a pair of laterally spaced brackets fixed upon the base member, each bracket having an upright arm, a pair of laterally spaced opposed columns extending vertically from the base, each column being removably bolted at its lower end to the upright arm of one of the brackets, a horizontally extending dowel rod slidably supported at its ends by the opposed columns, the rod being adapted to support a roll of wallpaper between the columns, a paper supporting panel extending horizontally between the columns and removably bolted at its ends to the columns, the panel being adapted to support upon its surface paper drawn over it from the roll, a cutter guide panel resting upon the paper supporting panel, means supporting the cutter guide panel upon the paper supporting panel for relative vertical slidable lifting of the cutter guide panel to allow paper drawn from the roll to be passed beneath the cutter guide panel and over the paper supporting panel, and the cutter guide panel having a longitudinally extending front edge adapted for guiding a knife that may be drawn along the edge for cutting the drawn paper from the roll.

7. A knockdown rack as in claim 6, wherein the rack may be knocked-down to its components by sliding the dowel rod free of the columns, unbolting the columns from the brackets, unbolting the paper supporting panel from the columns with the cutter guide panel resting upon it, and lifting the cutter guide panel free of the paper supporting panel.

8. A knockdown rack as in claim 7, wherein following disassembly of the rack into its components, the pair of columns with one resting upon the other are adapted to be laid upon a marginal surface area of the base member and removably bolted to the base member, and the cutter guide panel with the paper supporting panel resting upon it are adapted to be laid upon an adjacent surface area of the base member and removably bolted to the base member, whereby a compact pack is obtained for portage of the knocked-down rack.

* * * * *